US005944619A

United States Patent [19]

Cameron

[11] Patent Number: 5,944,619

[45] Date of Patent: Aug. 31, 1999

[54] GOLF CLUB WITH AN INSERT ON THE STRIKING SURFACE

[75] Inventor: Don T. Cameron, Carlsbad, Calif.

[73] Assignee: Acushnet Company, Fairhaven, Mass.

[21] Appl. No.: 08/711,337

[22] Filed: Sep. 6, 1996

[51] Int. Cl.[6] ..... A63B 53/04

[52] U.S. Cl. ..... 473/332; 473/342

[58] Field of Search ..... 473/332, 342; 273/78

[56] References Cited

U.S. PATENT DOCUMENTS

| | | | |
|---|---|---|---|
| D. 271,317 | 11/1983 | Bretl . | |
| D. 351,443 | 10/1994 | Caugh et al. . | |
| D. 373,161 | 8/1996 | Schmidt et al. . | |
| 572,436 | 12/1896 | Mills . | |
| 819,900 | 5/1906 | Martin . | |
| 873,423 | 12/1907 | Govan . | |
| 922,444 | 5/1909 | Youds . | |
| 1,046,343 | 12/1912 | Smith . | |
| 1,094,599 | 4/1914 | Samson . | |
| 1,253,700 | 1/1918 | McLaughlin . | |
| 1,383,654 | 7/1921 | Mattern . | |
| 1,617,090 | 2/1927 | Worthington . | |
| 2,034,936 | 3/1936 | Barnhart | 473/332 |
| 2,056,335 | 10/1936 | Wettlaufer . | |
| 2,429,351 | 10/1947 | Fetterolf . | |
| 2,463,798 | 3/1949 | Paisley . | |
| 2,592,013 | 4/1952 | Curley . | |
| 2,846,228 | 9/1958 | Reach . | |
| 3,134,596 | 5/1964 | Boznos . | |
| 3,172,667 | 3/1965 | Baker et al. . | |
| 3,211,455 | 10/1965 | Hyden . | |
| 3,218,072 | 11/1965 | Burr . | |
| 3,220,733 | 11/1965 | Saleeby . | |
| 3,233,905 | 2/1966 | Flom . | |
| 3,333,854 | 8/1967 | White . | |
| 3,547,445 | 12/1970 | Hardesty . | |
| 3,695,618 | 10/1972 | Woolley et al. . | |
| 3,817,522 | 6/1974 | Simmons . | |
| 3,863,932 | 2/1975 | Lezatte . | |
| 3,897,066 | 7/1975 | Belmont | 473/342 |
| 3,975,023 | 8/1976 | Inamori . | |
| 3,989,248 | 11/1976 | Campau . | |
| 4,121,832 | 10/1978 | Ebbing . | |
| 4,156,526 | 5/1979 | Huggins et al. . | |
| 4,193,601 | 3/1980 | Reid, Jr. et al. . | |
| 4,194,739 | 3/1980 | Thompson . | |
| 4,199,144 | 4/1980 | Skelly . | |
| 4,213,613 | 7/1980 | Nygren | 473/332 |
| 4,422,638 | 12/1983 | Tucker . | |
| 4,540,178 | 9/1985 | Johnson et al. . | |
| 4,573,685 | 3/1986 | Young, IV et al. . | |
| 4,618,149 | 10/1986 | Maxel . | |
| 4,679,792 | 7/1987 | Straza et al. . | |
| 4,681,322 | 7/1987 | Straza et al. . | |
| 4,730,830 | 3/1988 | Tilley . | |
| 4,749,197 | 6/1988 | Orlowski . | |
| 4,792,140 | 12/1988 | Yamaguchi et al. . | |

(List continued on next page.)

OTHER PUBLICATIONS

Golf Equipment Universal Catalogue, 1995, Grass Hunter golf clubs, p. 448.

*Primary Examiner*—Mark S. Graham
*Attorney, Agent, or Firm*—Pennie & Edmonds LLP

[57] ABSTRACT

A golf club head has a strike surface and an opposite back face. An insert of a material different than the club head is located on and is flush with the strike surface. A plurality of apertures extend from the back face of the club head towards the insert. Fastening means, such as threaded fasteners, extend through four of the apertures at the back face and attach the insert to the club head. The apertures are filled with an elastomeric material, which provides a vibration dampening feature upon impact of the club head with the golf ball. The vibration dampening feature of the club improves the feedback or the overall feel of the club given to the golfer at impact. The size of the apertures and the amount of the elastomeric material in the apertures combine to vary the amount of vibration dampening and to vary the feel of the club.

22 Claims, 19 Drawing Sheets

U.S. PATENT DOCUMENTS 4,804,188 2/1989 McKee et al. .
4,812,187 3/1989 Honma .
4,881,739 11/1989 Garcia .
4,883,275 11/1989 Boone .
4,884,808 12/1989 Retzer .
4,928,965 5/1990 Yamaguchi et al. .
4,930,781 6/1990 Allen .
4,934,703 6/1990 Delaney .
4,941,666 7/1990 Suganuma .
5,016,883 5/1991 Kobayashi .
5,060,951 10/1991 Allen .
5,064,197 11/1991 Eddy .
5,078,397 1/1992 Aizawa .
5,078,398 1/1992 Reed et al. .
5,082,278 1/1992 Hsien .
5,083,778 1/1992 Douglass .
5,141,231 8/1992 Cox .
5,154,425 10/1992 Niskanen et al. .
5,219,408 6/1993 Sun .
5,221,087 6/1993 Fenton et al. .
5,271,622 12/1993 Rogerson .
5,290,036 3/1994 Fenton et al. ..... 473/332
5,299,807 4/1994 Hutin .
5,301,941 4/1994 Allen .
5,303,922 4/1994 Lo .
5,332,214 7/1994 Tucker, Sr. .
5,342,052 8/1994 Costa .
5,346,213 9/1994 Yamada .
5,354,059 10/1994 Stuff .
5,362,055 11/1994 Rennie .
5,385,348 1/1995 Wargo .
5,398,929 3/1995 Kitaichi .
5,405,137 4/1995 Vincent et al. .
5,407,202 4/1995 Igarashi .
5,425,535 6/1995 Gee .
5,429,354 7/1995 Long et al. .
5,431,396 7/1995 Shieh .
5,437,447 8/1995 Rigutto .
5,447,311 9/1995 Viollaz et al. .
5,529,543 6/1996 Beaumont, Sr. ..... 473/332

GOLF CLUB WITH AN INSERT ON THE STRIKING SURFACE

TECHNICAL FIELD

The present invention relates to golf clubs and, more particularly, to a golf club that has an insert on the strike surface of the club.

BACKGROUND OF THE INVENTION

Golf clubs have long been developed to improve the "touch and feel" of the club, most particularly with, but not limited to, the clubs used on and around the green. One approach to improve the touch and feel of a club is to modify either the grip, the shaft, or the strike face of the golf club. For example, modifications to the club head could include an insert that is placed on the club strike surface to affect the impact of the club with the golf ball and to improve the feedback to the golfer after impact.

SUMMARY OF THE INVENTION

An object of the present invention is to provide a golf club with an improved "touch and feel" on and around the green.

Another object of the present invention is to provide a golf club with an insert on the strike face that affects the rebound of the golf ball at impact with the strike face.

Another object of the present invention is to provide a golf club that dampens vibrations and improves the feedback to the golfer at impact of the golf club with the golf ball.

According to the present invention, a golf club is provided that improves a golfer's touch and feel around and on the green wherein the golf club has an insert located on a strike face and a vibration dampening means on a back face of the club head.

In the preferred embodiment, a golf club head has a strike surface and an opposite back face. An insert of a material different than the club head is located on and is positioned flush with the strike surface. Preferably, a plurality of apertures extend from the back face of the club head toward the insert. Most preferably, the plurality of apertures extend through the back face to the insert. Fastening means, such as threaded fasteners, extend through a plurality of the apertures at the back face and connect the insert to the club head. The apertures are filled with an elastomeric material, which provides a vibration dampening feature upon impact of the club head with the ball. The vibration dampening feature of the club head improves the feedback or the overall feel of the club given to the golfer at impact. The size of the apertures and the amount of the elastomeric material in the apertures combine to vary the amount of vibration dampening and to vary the feel of the club.

In a separate embodiment, the club is essentially the same as the above disclosed preferred embodiment except that there is a gap between the insert and the back face of the club. The gap is filled with a vibration dampening means, such as an elastomeric material.

In yet another separate embodiment, the club is essentially the same as the above disclosed preferred embodiment except that the club head has a continuous passageway or passageways that interconnect with the plurality of apertures. Preferably, the passageway is in the insert back face. The passageway interconnects with the plurality of apertures and the elastomeric material extends from the apertures into the insert passageway. The insert passageway and the apertures combine to vary the amount of vibration dampening and to vary the feel of the club.

DETAILED DESCRIPTION OF THE INVENTION

Figure 1:
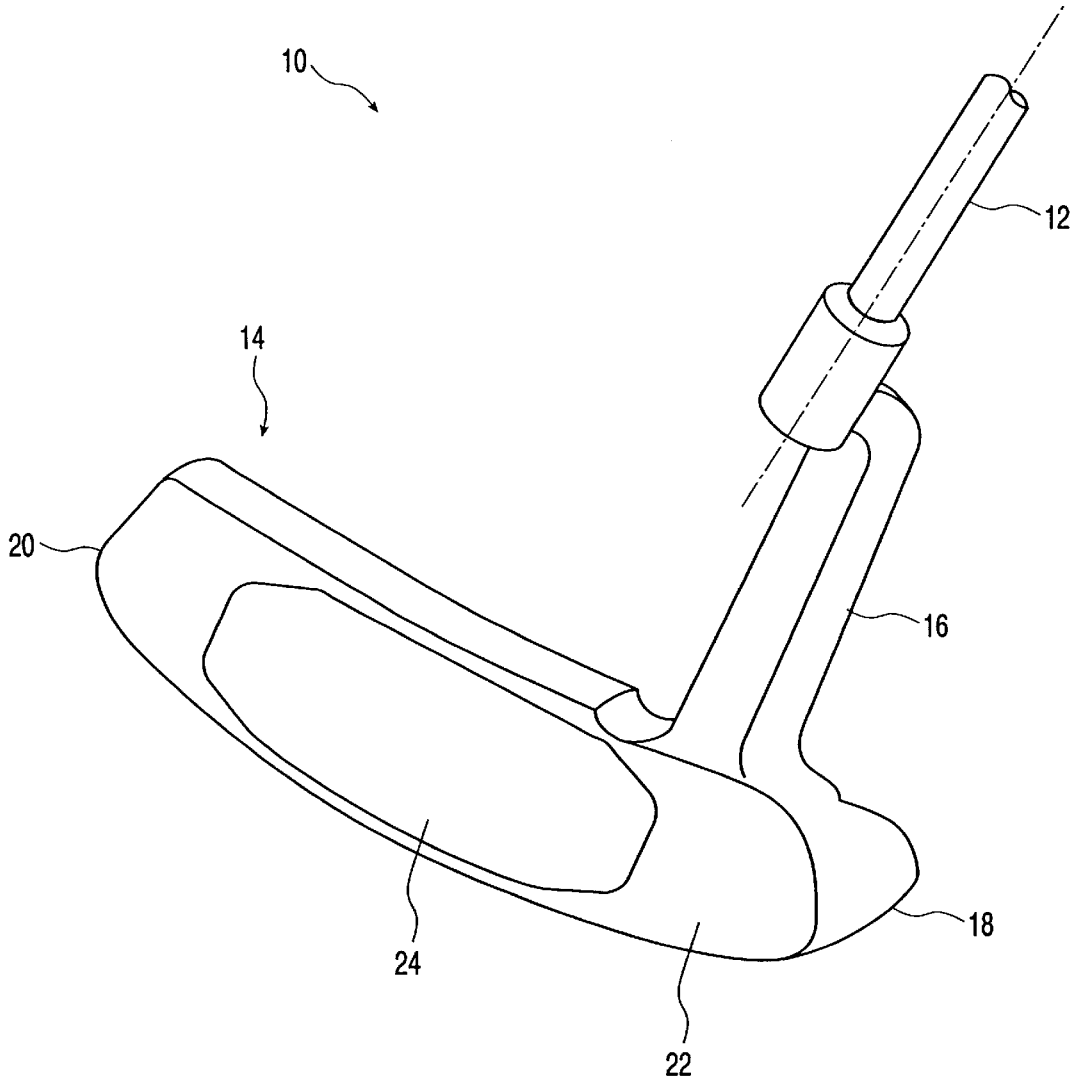
FIG. 1 is a front perspective view of a golf club head of the present invention showing an insert located on a strike face.
Figure 2:
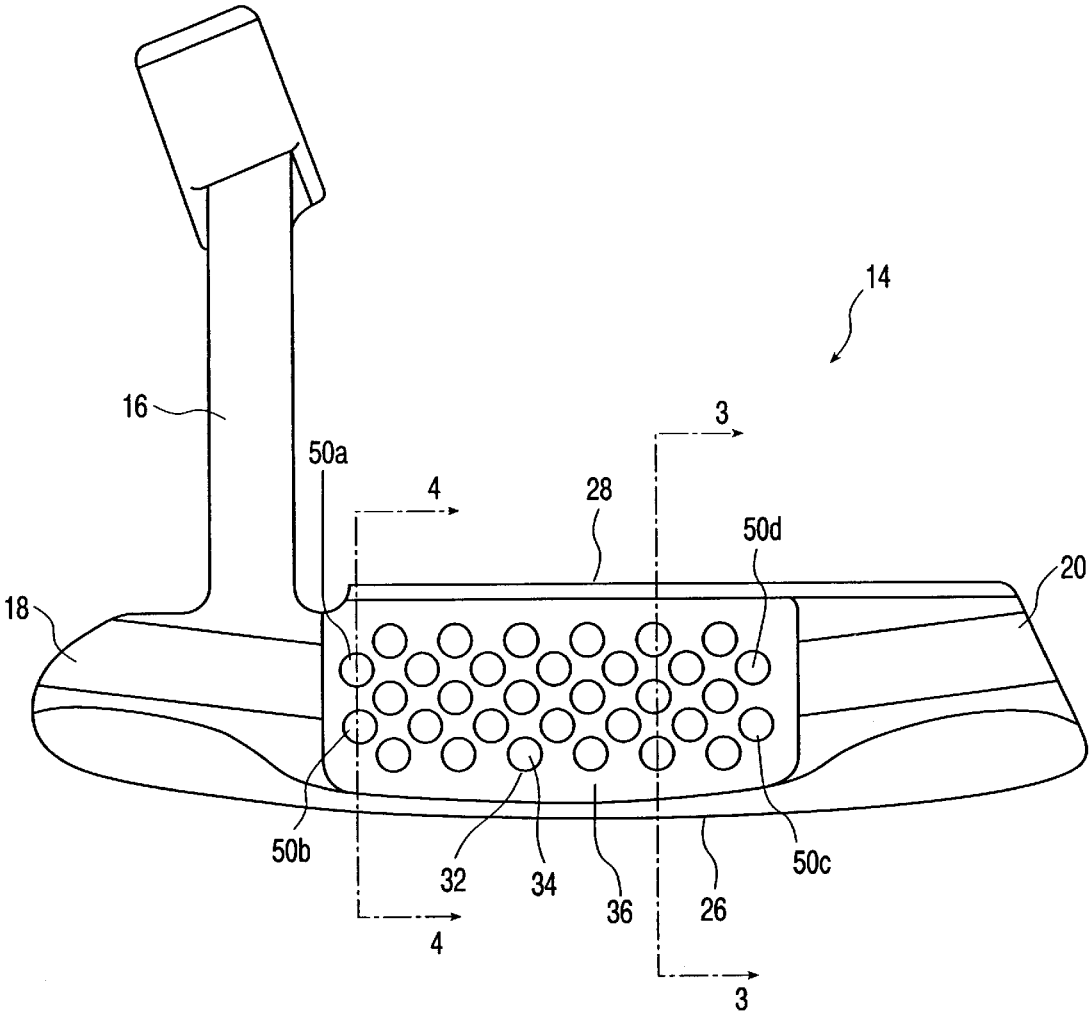
FIG. 2 is an rear view of the golf club head of the present invention showing a plurality of apertures spaced apart on a back face of a club head.

According to the present invention and referring to FIGS. 1 and 2, a golf club 10 has a shaft 12 (only partially shown) attached to a club head 14. A putter-type club head is shown in FIG. 1, however, as explained below, an iron-type club head may also be utilized with the present invention.

The club head 14 has a hosel 16 that accepts the shaft 12 with a heel 18 at the hosel end of the club head 14 and a toe 20 opposite of the heel 18. The club head 14 also has a sole portion 26 and an opposite top portion 28. Extending between the heel 18 and the toe 20 is a strike face 22, which is the surface that contacts the golf ball (not shown) upon impact between the golf club 10 and the ball. The strike face 22 includes a "sweet spot", or the center of gravity in the toe to heel direction, which is covered with an insert 24. The insert 24 is made of a material that is different than the rest of the club head. In the preferred embodiment, the insert is made of a tellurium copper alloy, which is a relatively soft alloy that improves the touch and feel of the club. In the preferred embodiment, the tellurium copper alloy includes a minimum of 99.4% copper, a maximum of 0.004–0.012 ppm of phosphorus and a maximum of 0.4–0.7 ppm of tellurium, and has a hardness of approximately 80 HB.

As shown in FIG. 2, the club head 14 has an essentially flat back face portion 36 that extends partially between the heel 18 and the toe 20 and partially between the top portion 28 and the sole portion 26. The back face portion 36 has a plurality of apertures 32 that are preferably evenly spaced apart in relation to each other, that follow the contour of the back face portion 36 and that are essentially perpendicular to the strike face 22.

Figure 3:
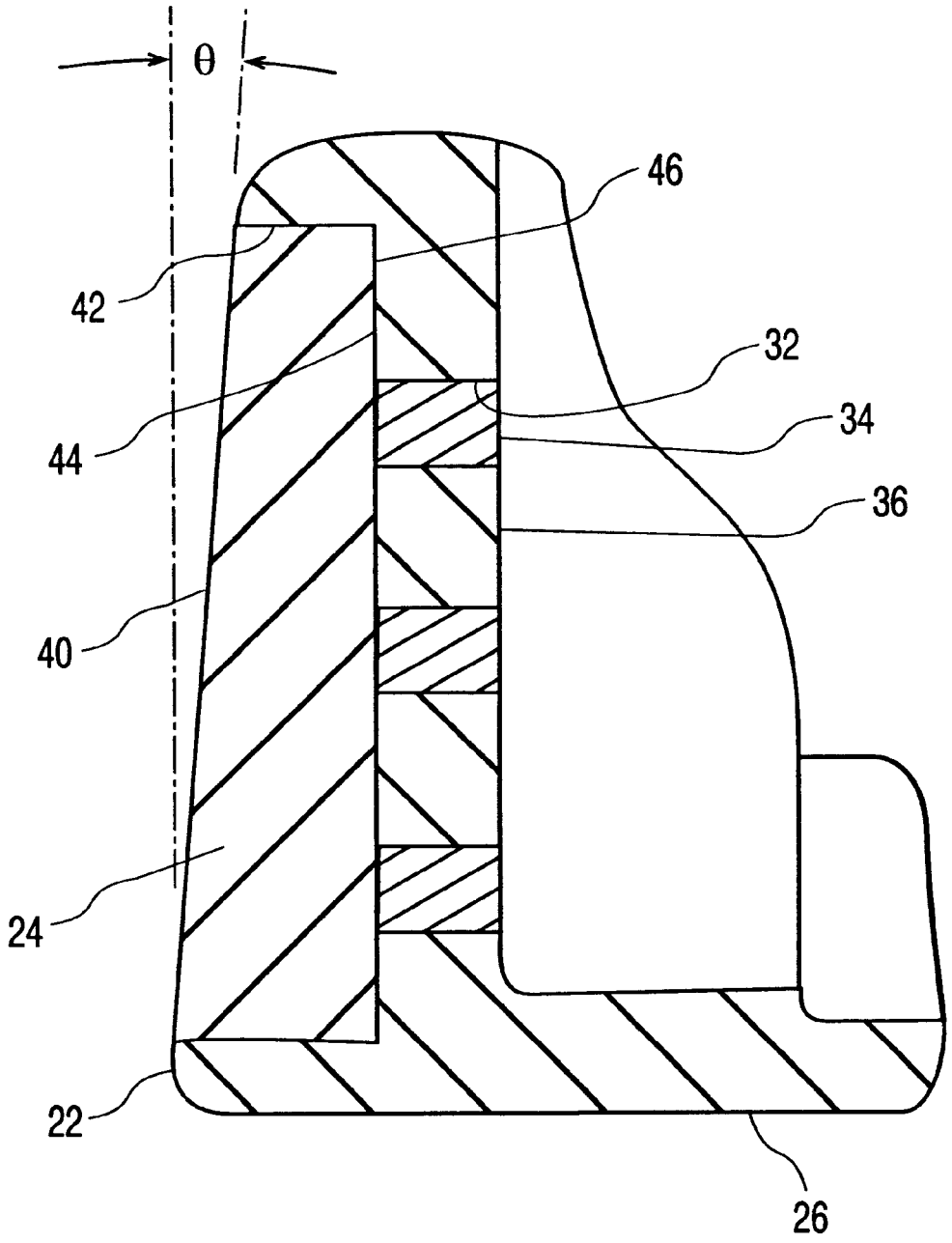
FIG. 3 is a cross-sectional view taken from line 3—3 of FIG. 2 showing the apertures filled with an elastomeric material.

As shown in FIG. 3, the apertures 32 extend from the back face 36 toward the insert 24. Preferably more than five apertures are used, more preferably there are greater than 20 apertures, and most preferably there are 32 apertures. A vibration dampening means, such as an elastomeric material 34 that is deformable is located in each aperture 32. In the preferred embodiment, which will be described in detail below, the elastomeric material is a silicone material, Stock No. GE281, available from General Electric Company in Waterford, N.Y.

As shown in FIG. 3, the insert 24 is press fit into a complementary strike face recess 42. The interference fit between the insert 24 and the strike face recess 42 is approximately 0.002–0.003 inches. The insert 24 has a back face 46, which is in contact with and adjacent to a recess bottom surface 44. The contact between the two surfaces creates a metal-to-metal contact between the insert 40 and the recess bottom surface 44. The size of the apertures 32 and the volume of the elastomeric material 34 located in the apertures combine to reduce the amount of metal-to-metal 35 contact between the insert 40 and the recess bottom surface 44. Therefore, the "touch and the feel" of the putter may be altered by varying the amount of metal-to-metal contact and by proportionately varying amount of elastomeric material located in the back face 36.

The insert 24 has a strike face 40 that is essentially axially aligned with the club head strike face 22. The strike faces 22 and 40 have a loft angle θ, which for a standard lofted putter the loft angle is approximately 4 degrees.

Figure 4:
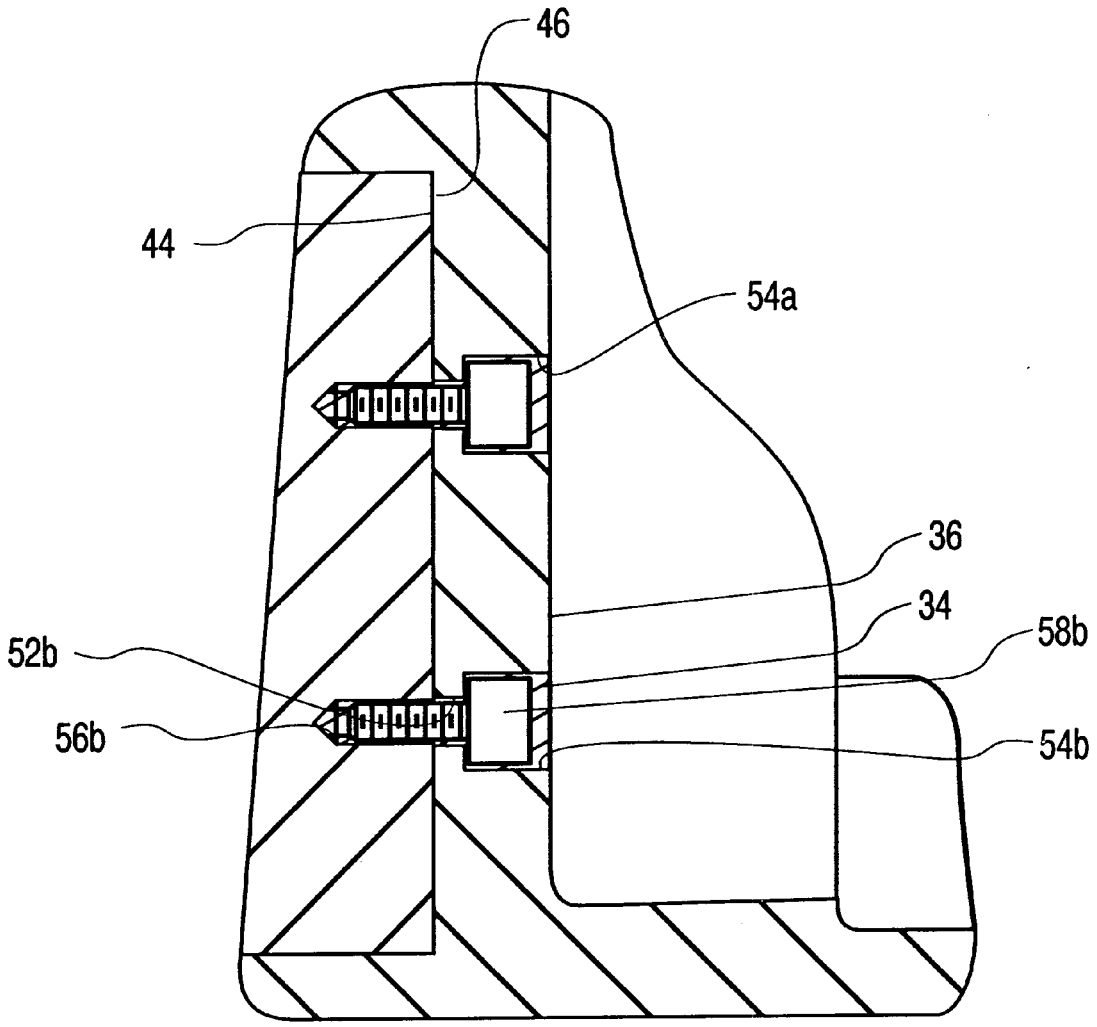
FIG. 4 is a cross-sectional view taken from line 4—4 of FIG. 2 showing fasteners extending through the back face and into the insert.
Figure 5:
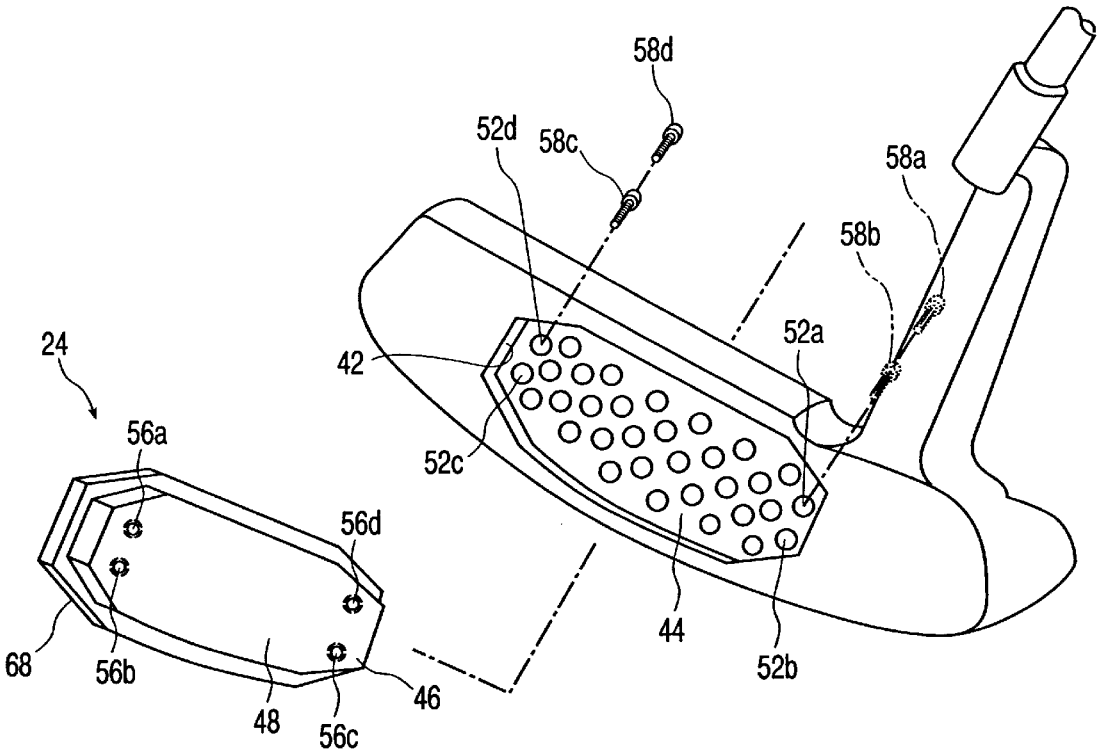
FIG. 5 is an exploded front perspective view of the golf club of the present invention showing the club head before assembly.

Referring now to FIGS. 2, 4 and 5, four of the outermost apertures 50*a*, 50*b*, 50*c* and 50*d* accept a fastening means. In the embodiments described herein, the additional fastening means is four (4) allen head fasteners with a "0" primary size and a Fine UNF thread rating of 80 by 0.250 inches long, which is represented by numerals 58*a*, 58*b*, 58*c* and 58*d*. The outermost apertures 50*a*, 50*b*, 50*c* and 50*d* follow the outer contour of the back face 36 and each have a complementary clearance hole 52*a*, 52*b*, 52*c* and 52*d* and a complementary counterbore 54*a*, 54*b*, 54*c* and 54*d* (only counterbores 54*a* and 54*b* are shown in FIG. 4).

Figure 6:
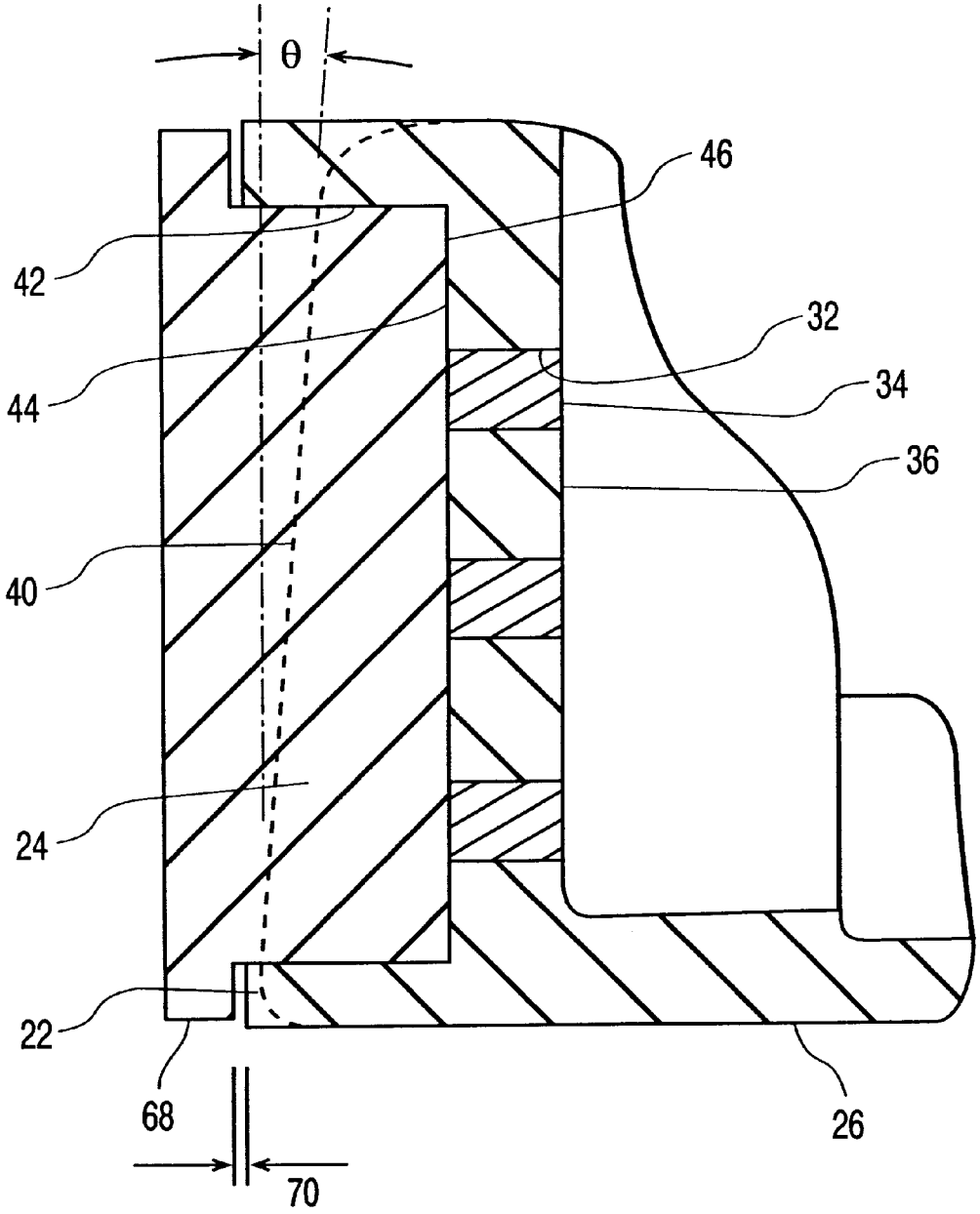
FIG. 6 is a cross-sectional view similar to FIG. 3 showing the insert positioned in the strike face side of the club head before the final machining operation.

FIG. 5 shows an exploded view of the club head 14 prior to assembly. The insert back face 46 has four threaded holes 56*a*, 56*b*, 56*c* and 56*d* that are complimentary to the clearance holes 52*a*, 52*b*, 52*c* and 52*d*. The insert 24 has a flange 68 and is press fit into the insert strike face 42 with an arbor press with the arbor press applying pressure to the flange 68 so that the insert back face 46 is in full contact with the recess bottom surface 44 after insertion. As shown in FIG. 6, the insert 24 bottoms out against the recess bottom surface 44. The insert 24 is deeper than the depth of the strike face recess 42 so that the insert 24 bottoms out and 30 so that there is a gap 70 between the flange 68 and the club head 14. The four fasteners 58*a*, 58*b*, 58*c* and 58*d* are then fastened into the insert 24, which further connects the insert 24 into the strike face recess 42. Then during a machining process, the flange 68 is then machined off as the strike surface 22, the insert 24 and the loft of the club are defined. Finally, the elastomeric material 34 is inserted into the apertures 32 and into the outermost apertures 50. A squeegee is scraped across the back face 36 to remove the excess silicone, leaving the silicone in each of the apertures, which also covers the heads of the fasteners so that the fasteners are not visible from the back face 36.

Figure 7:
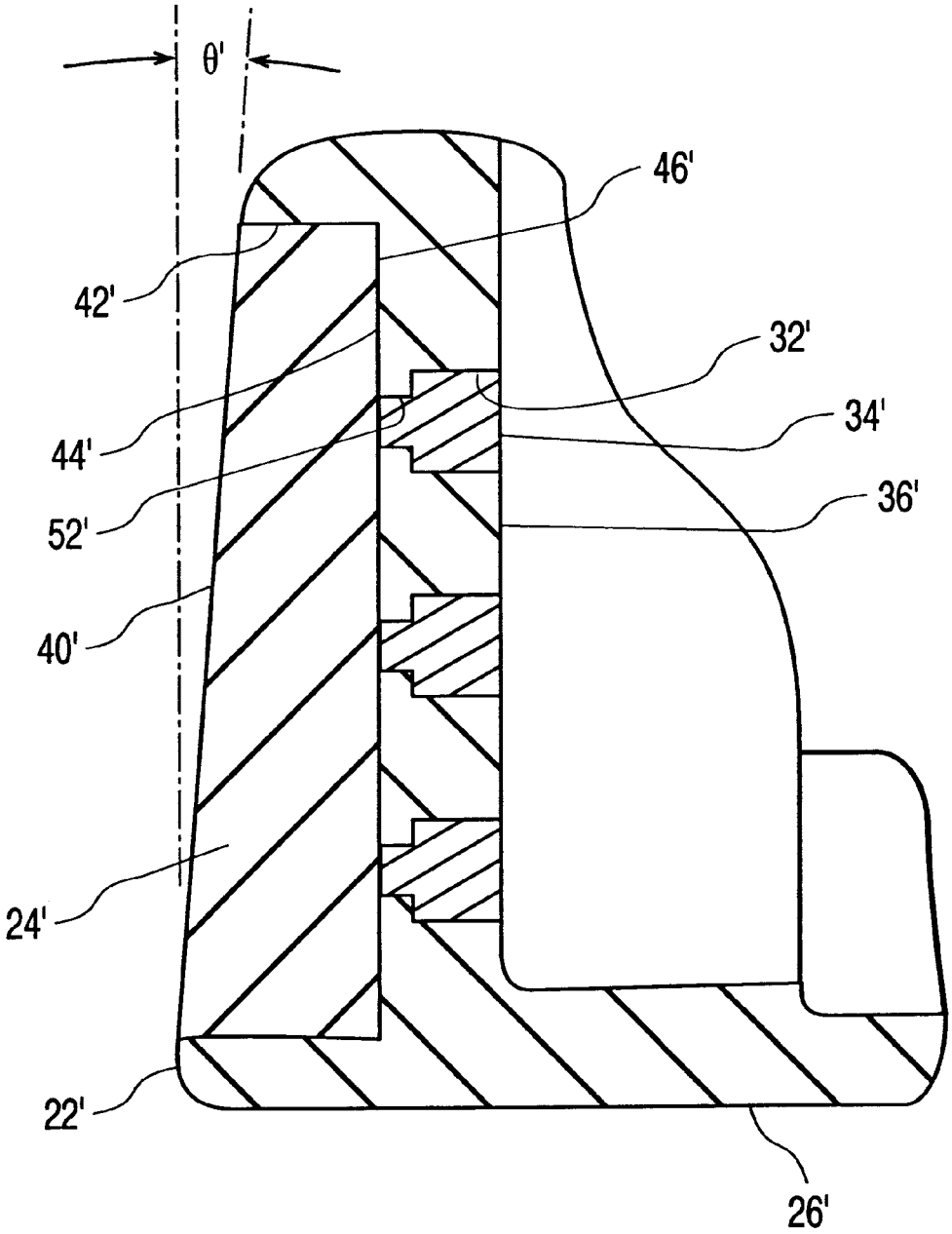
FIG. 7 is a cross-sectional view similar to FIG. 3 showing a separate embodiment of the golf club head of the present invention.

The preferred embodiment is shown in FIG. 7, wherein the embodiment is essentially the same as described above, except that all of the apertures are counterbored. This embodiment reduces the amount of silicone material 34' that is in contact with the insert 24', which in turn affects the touch and feel of the club. The clearance holes 52', as in the above described embodiment, have a diameter of approximately 0.06–0.08 inches.

Figure 8:
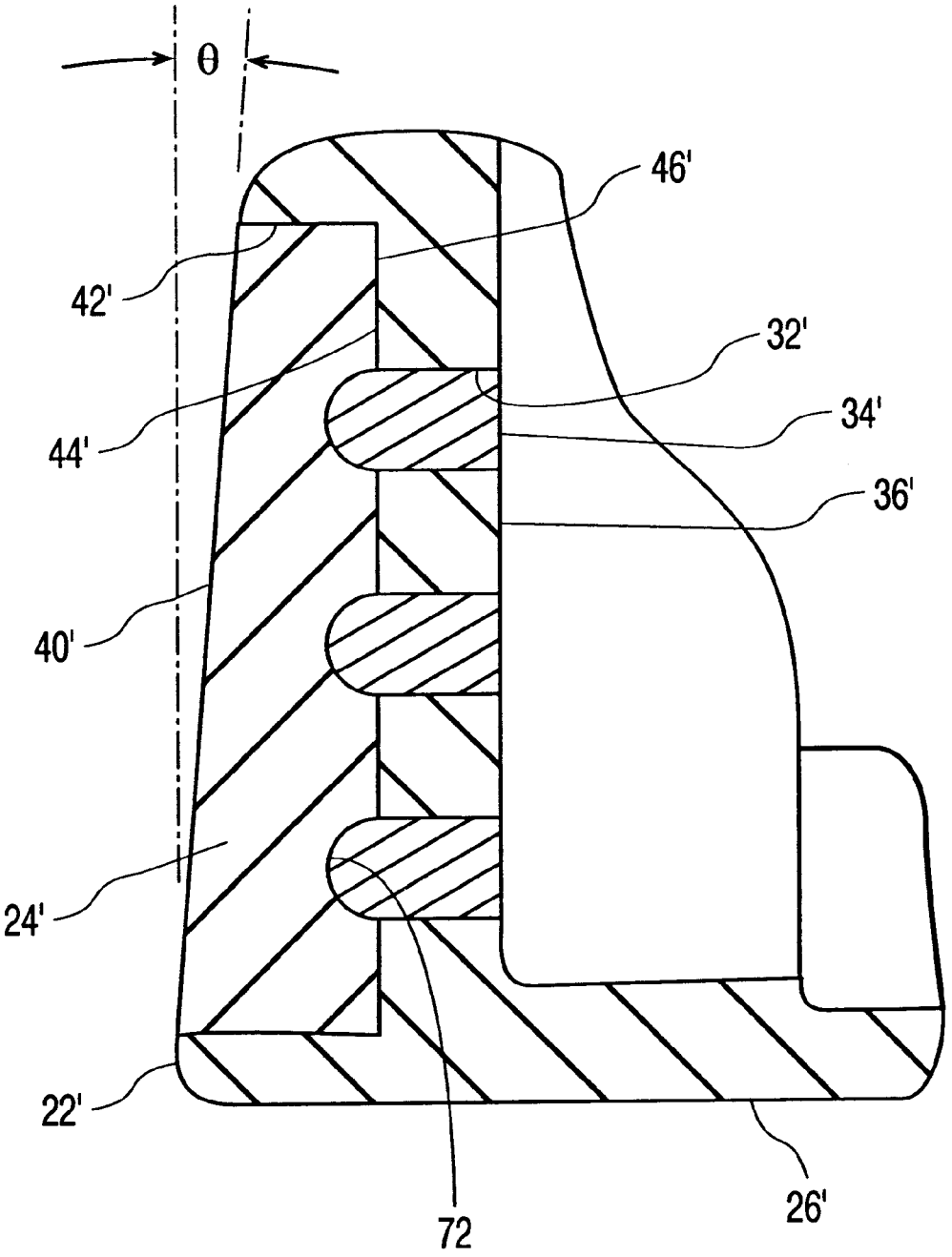
FIG. 8 is a cross-sectional view similar to FIG. 3 showing a separate embodiment of the golf club head of the present invention.
Figure 9:
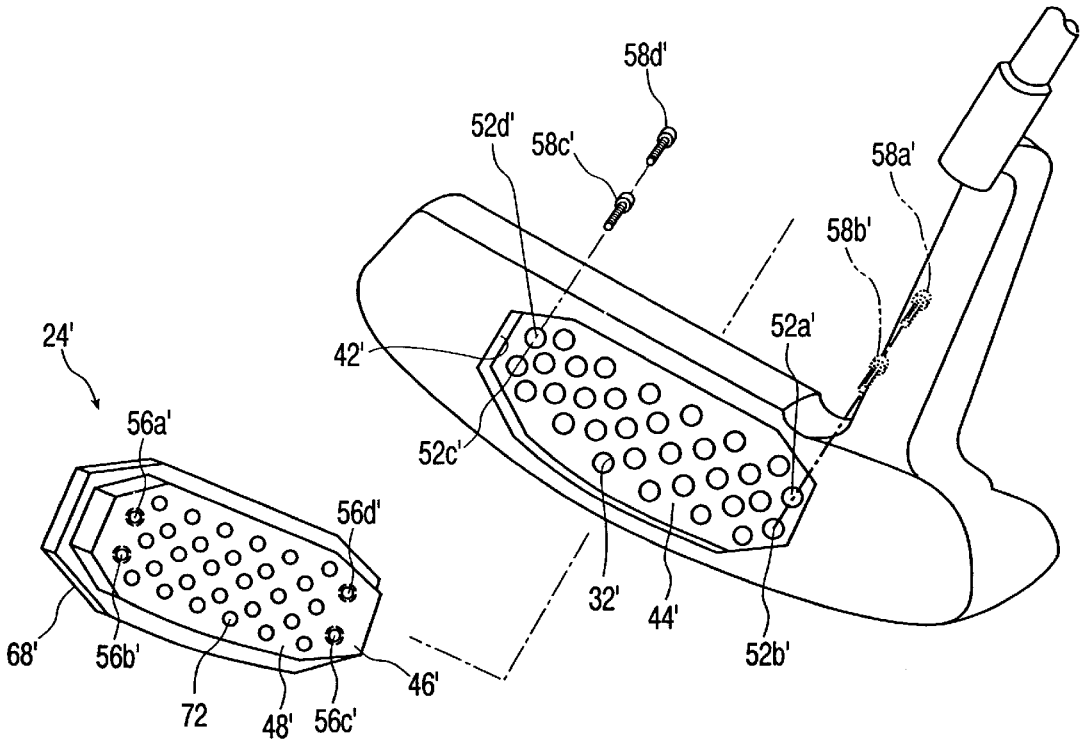
FIG. 9 is an exploded front perspective view of the embodiment shown in FIG. 8 showing the golf club head before assembly.

A separate embodiment is shown in FIGS. 8-9, which is similar to the above disclosed embodiment shown in FIG. 3, except that the insert 24' has a plurality of insert cavities 72. The insert cavities 72 are aligned to be complementary to the plurality of apertures 32'. This embodiment provides a more pronounced vibration dampening feature than the embodiment disclosed in FIG. 3 since the elastomeric material 34' extends into the insert back face 46'.

Figure 10:
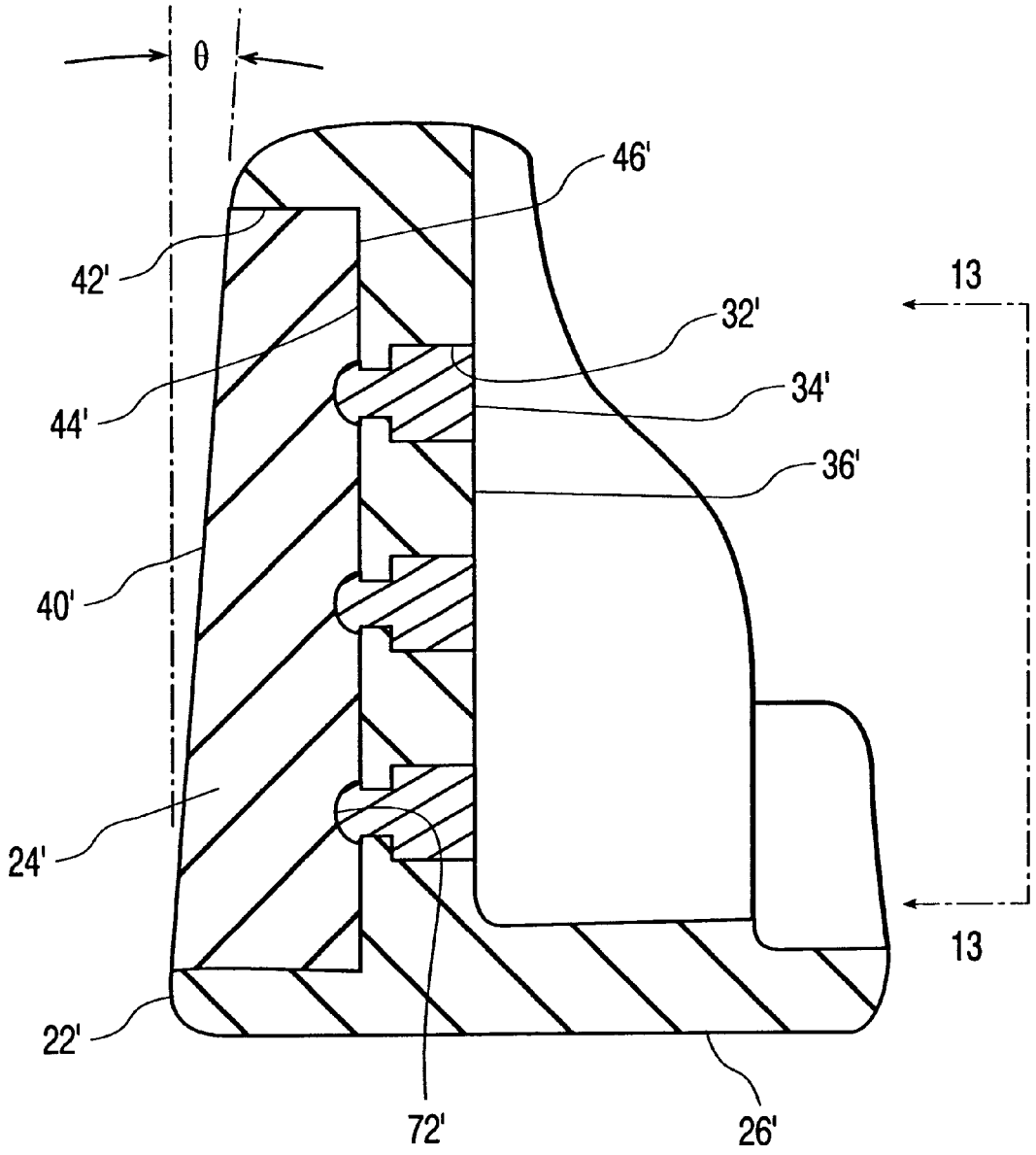
FIG. 10 is a cross-sectional view similar to FIG. 3 showing a separate embodiment of the golf club head of the present invention.
Figure 11:
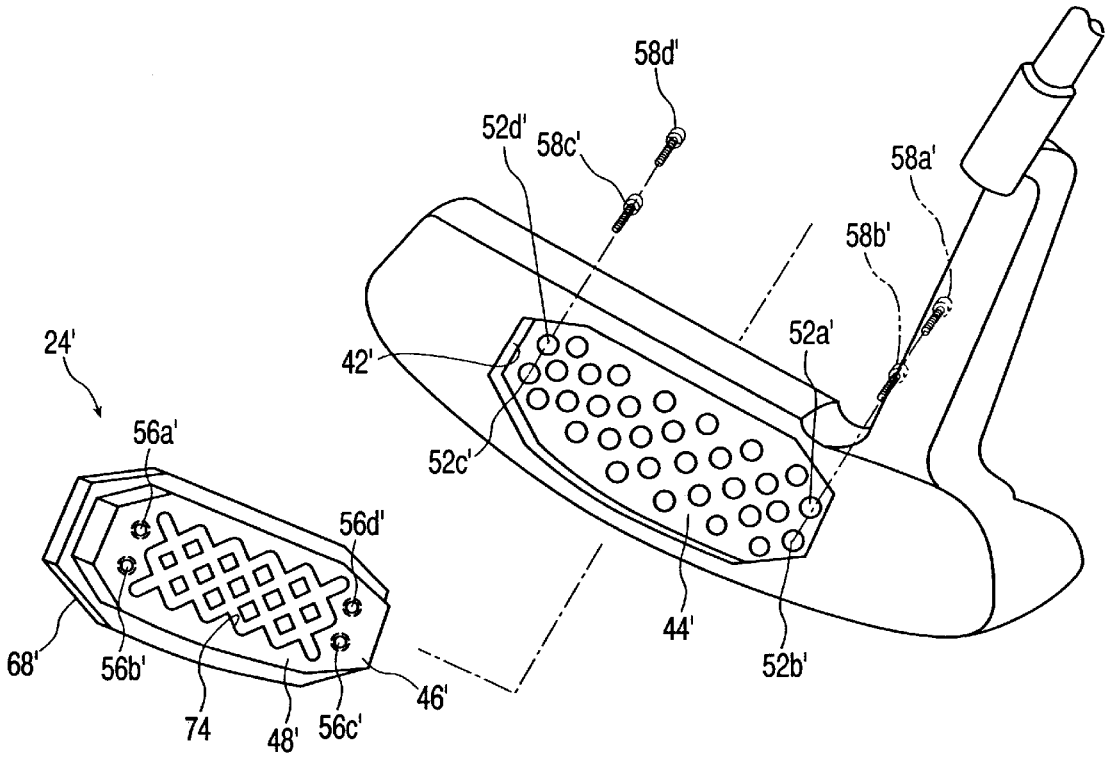
FIG. 11 is an exploded front perspective view of the embodiment shown in FIG. 10 showing the golf club head before assembly.
Figure 12:
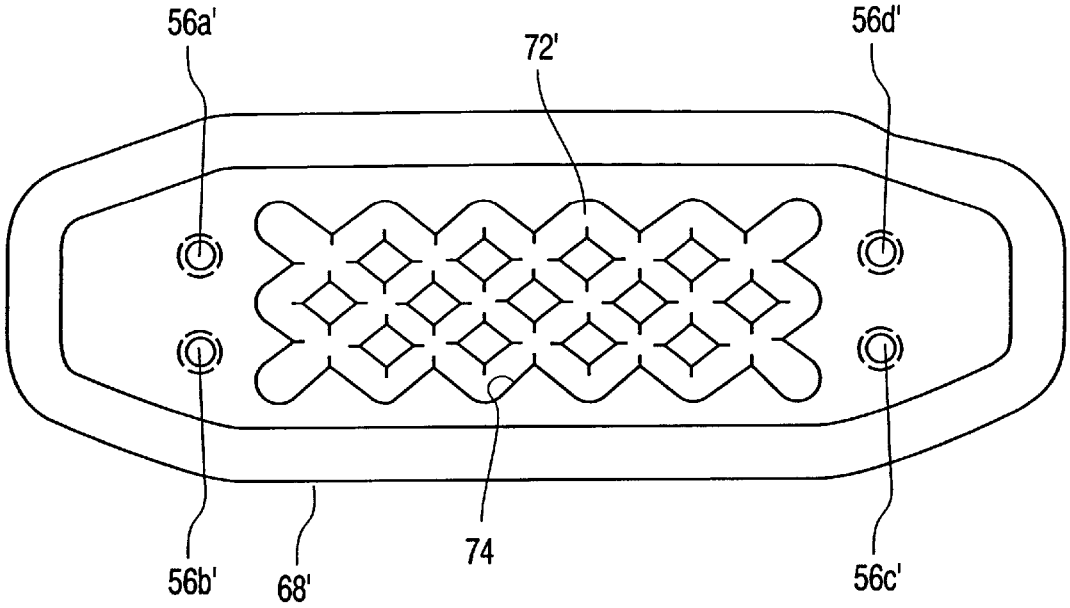
FIG. 12 is an elevational view FIG. 11 showing the back face of the insert.

Yet another embodiment is shown in FIGS. 10–13. FIG. 10 is similar to the cross-sectional view of FIG. 8. This embodiment is similar to the embodiment shown in FIGS. 8–9, except that all of the apertures are counterbored, as disclosed in the embodiment shown in FIG. 7, and that the insert back face 46' has a continuous passageway 74, or a matrix, that connects each of the insert cavities 72'. The passageway is made with a 1/16 inch ball end mill. The continuous passageway 74 provides a more pronounced vibration dampening feature than the embodiment disclosed in FIGS. 3 and 8 since the elastomeric material 34' extends into the insert back face 46' and since it encompasses more area on the insert back face 46'.

Figure 13:
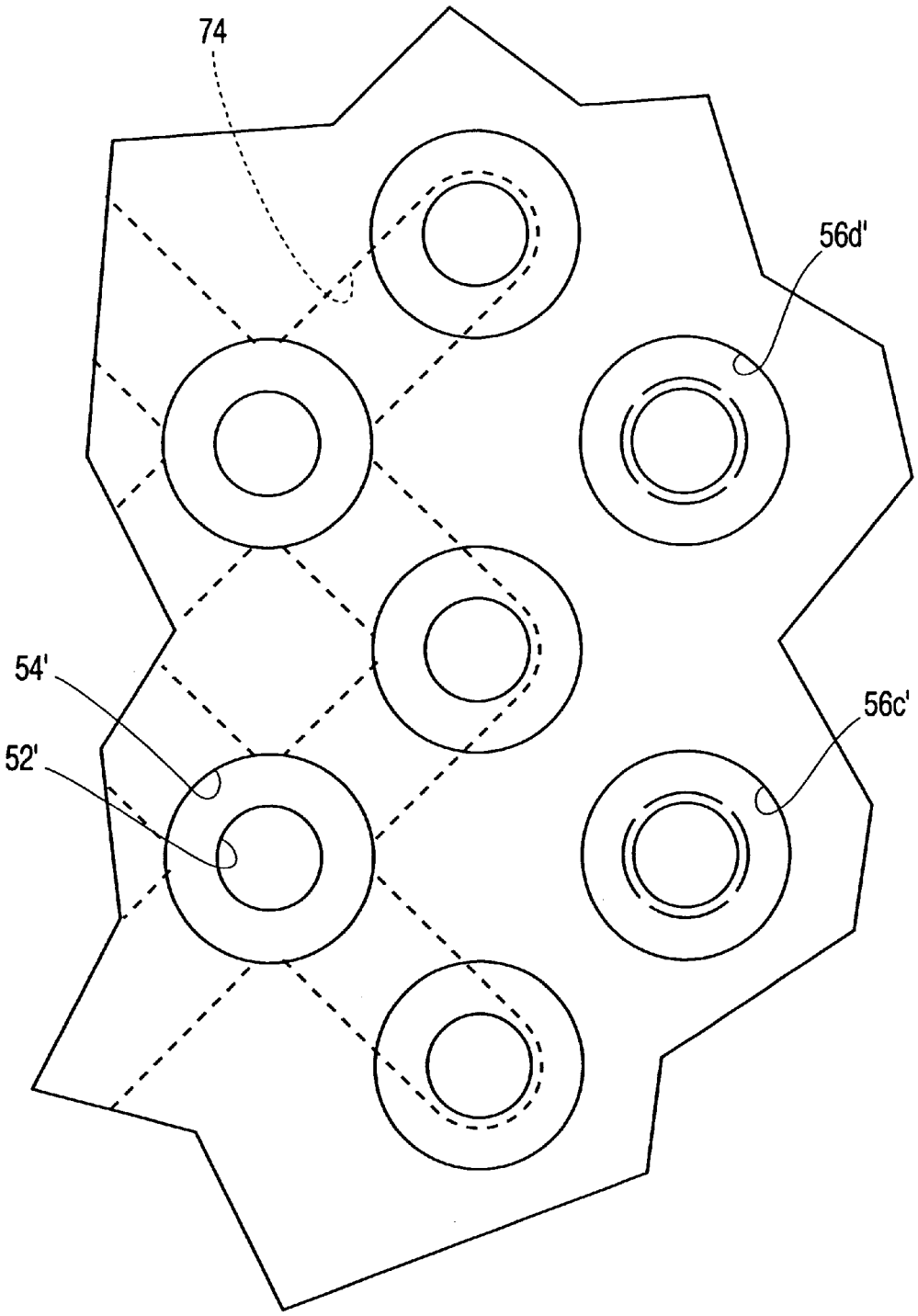
FIG. 13 is a view taken from line 13—13 of FIG. 10 showing the club head back face with the elastomeric material and the fasteners removed.

FIG. 13 shows the club head assembled, but without the fasteners and the silicone material in the apertures, with the passageway 74 being aligned with each of the apertures.

Figure 14:
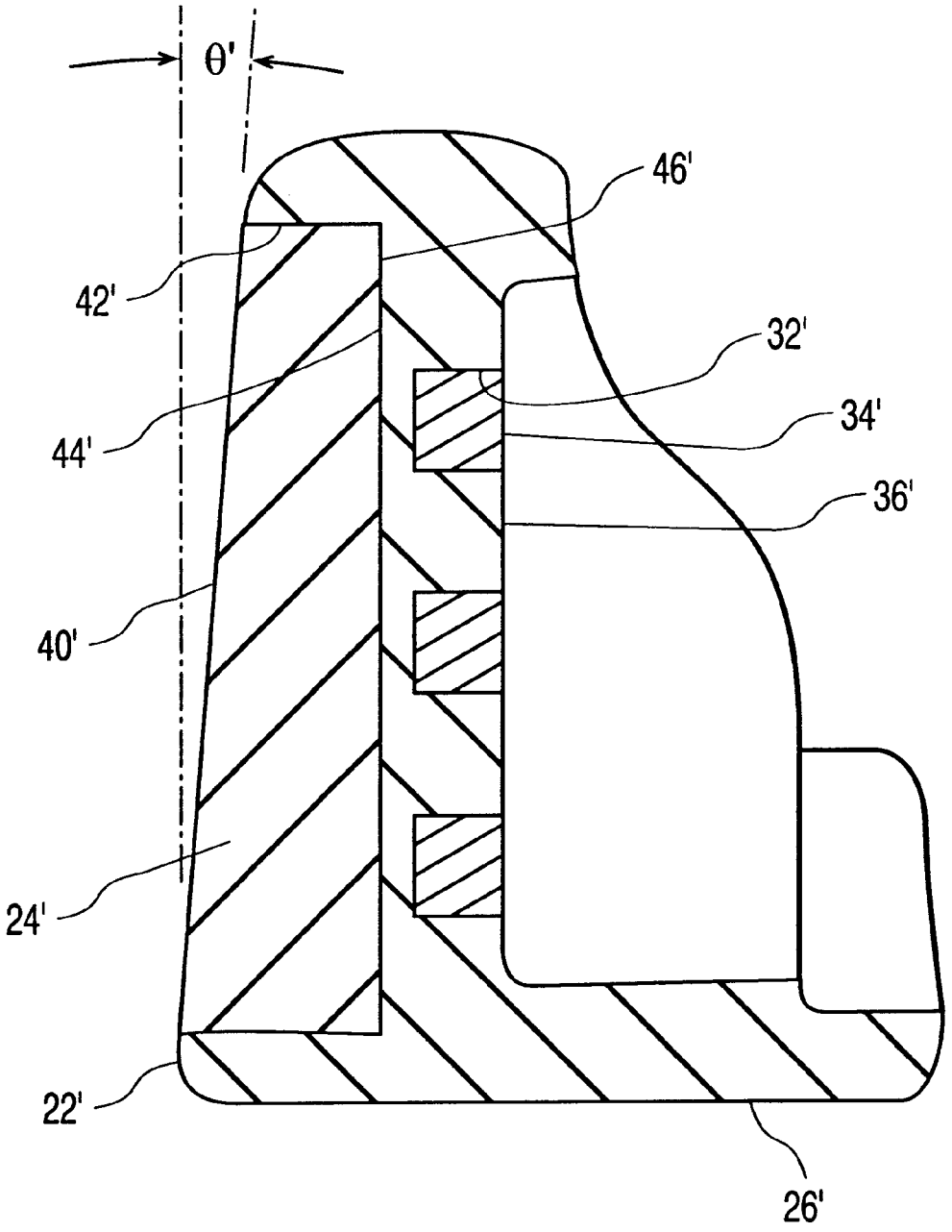
FIG. 14 is a cross-sectional view similar to FIG. 3 showing a separate embodiment of the golf club head of the present invention.

Another embodiment is shown in FIG. 14, which is similar to the embodiment shown in FIG. 3, except that the apertures 32' do not extend into the strike face recess 42'. This embodiment provides a lesser amount of vibration dampening compared to the other above described embodiments.

Figure 15:
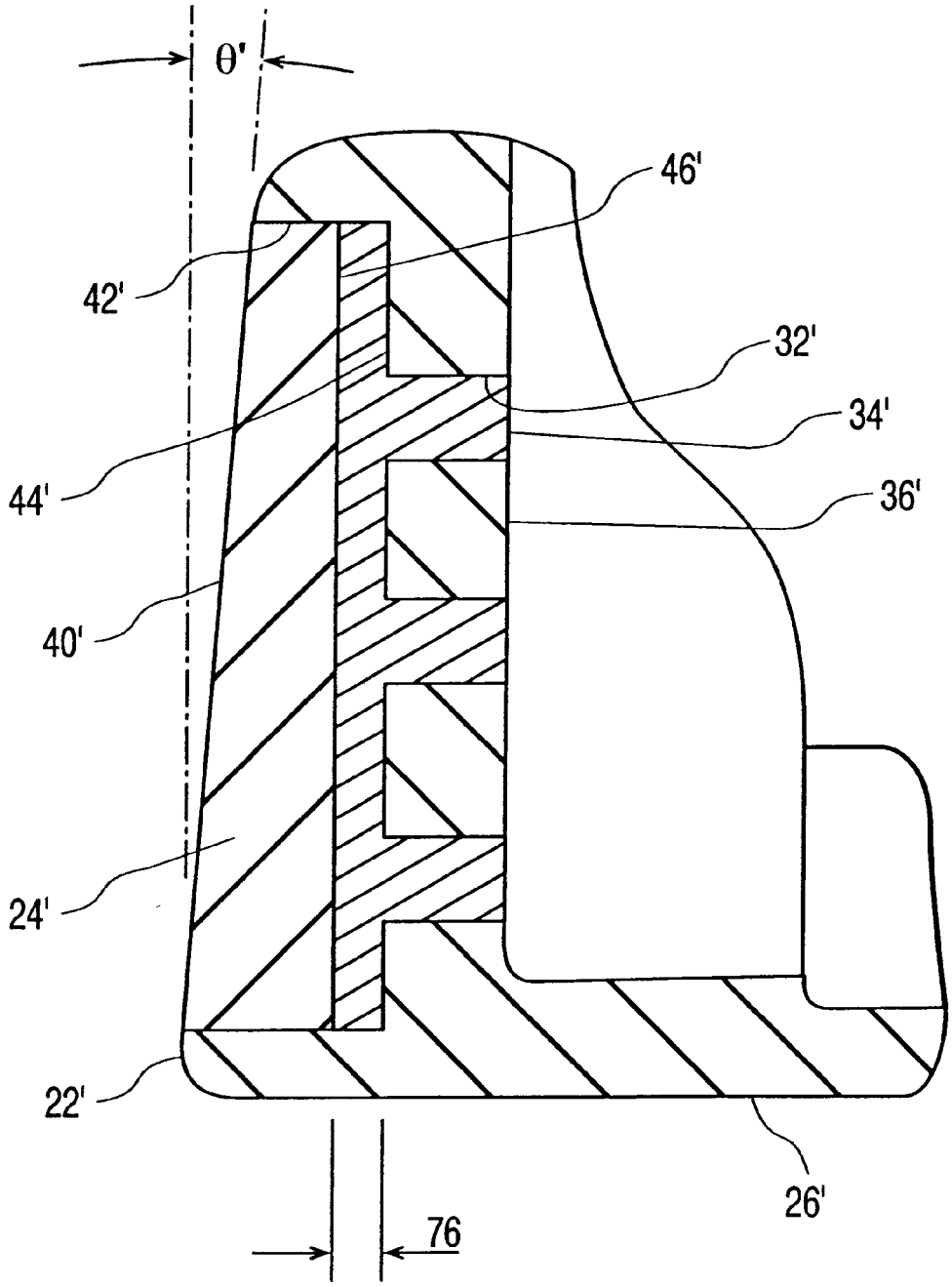
FIG. 15 is a cross-sectional view similar to FIG. 3 showing a separate embodiment of the golf club head of the present invention.
Figure 16:
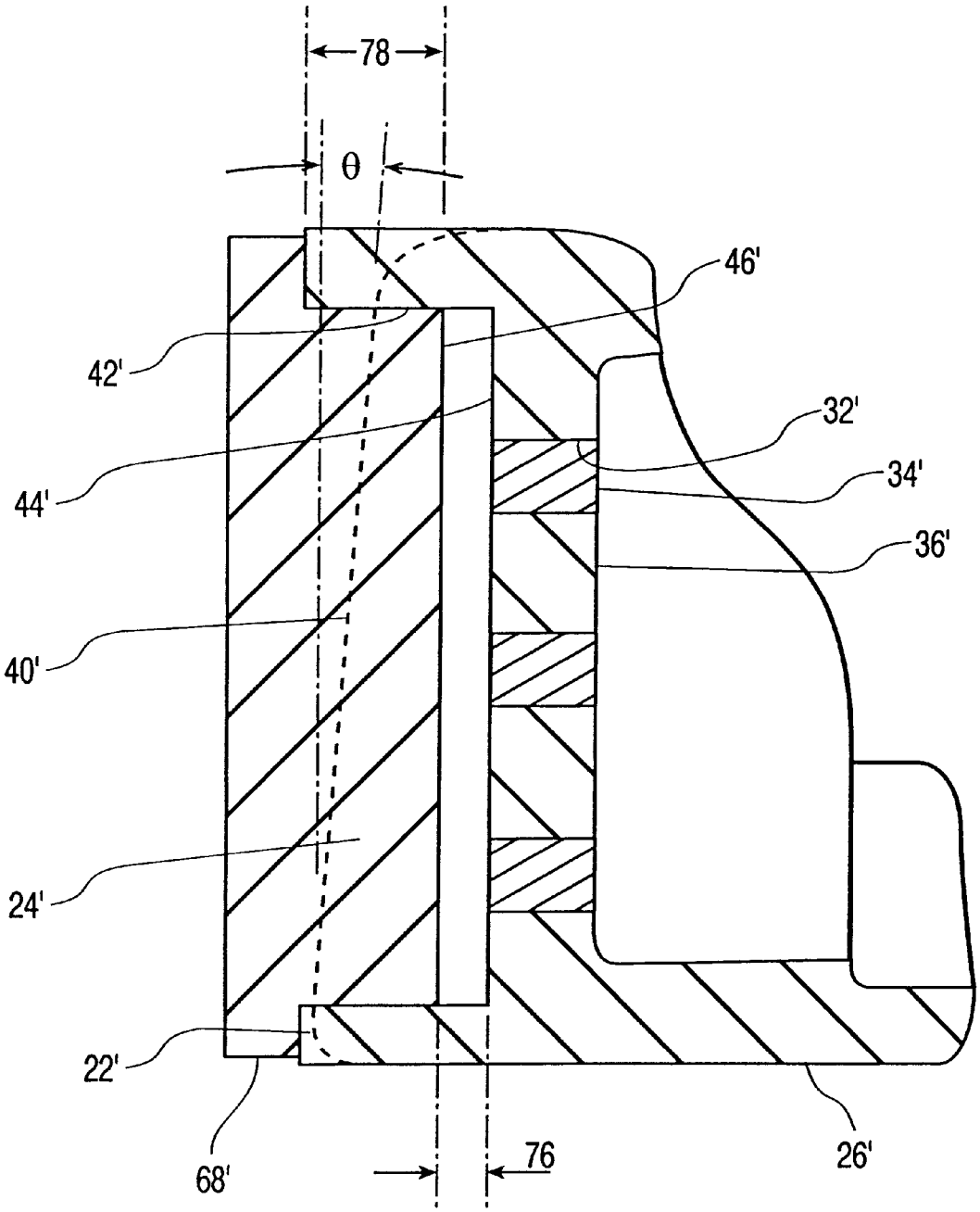
FIG. 16 is a cross-sectional view similar to FIG. 6 showing the insert positioned in the strike face side of the club head before the final machining operation.

Yet another embodiment is shown in FIGS. 15–16, which is similar to the embodiment described in FIG. 3, except that there is a gap 76 between the insert back face 46' and the strike face recess bottom surface 44'. As shown in FIG. 16, the gap 76 may be predetermined by a flange to insert back face dimension 78, so that when the insert 24' is press fit into the strike face recess 42', the gap dimension is determined. A second vibration dampening means, such as foam rubber, may be inserted in the gap 76. In the alternative, the gap 76 is filled with elastomeric material 34'. The flange 68' is then machined off, as described in detail above.

Figure 17:
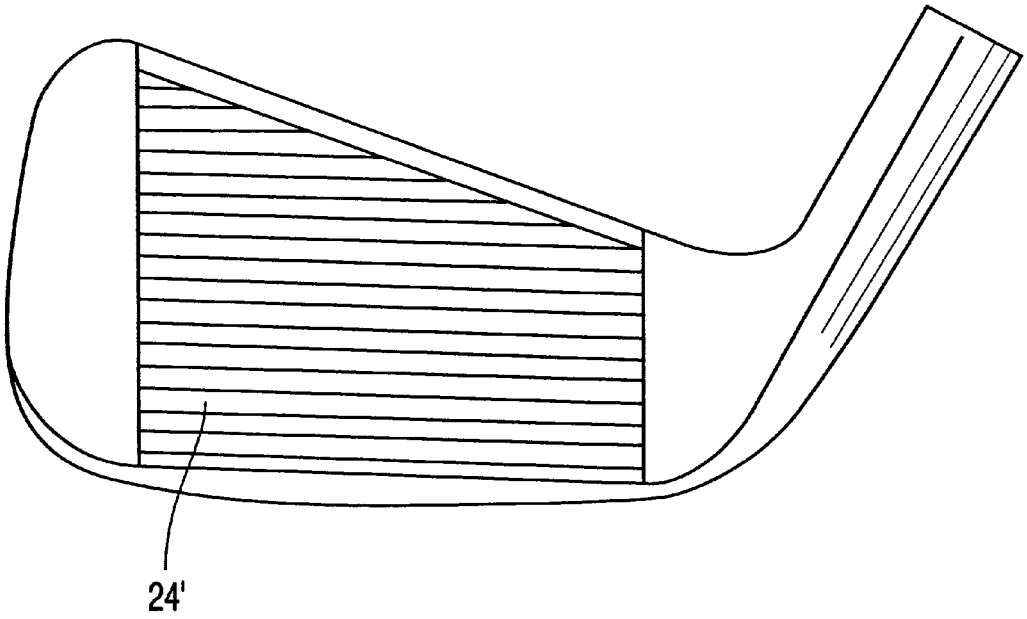
FIG. 17 is a front perspective view of separate embodiment of a golf club head of the present invention showing an insert located on a strike face of an iron-type club.
Figure 18:
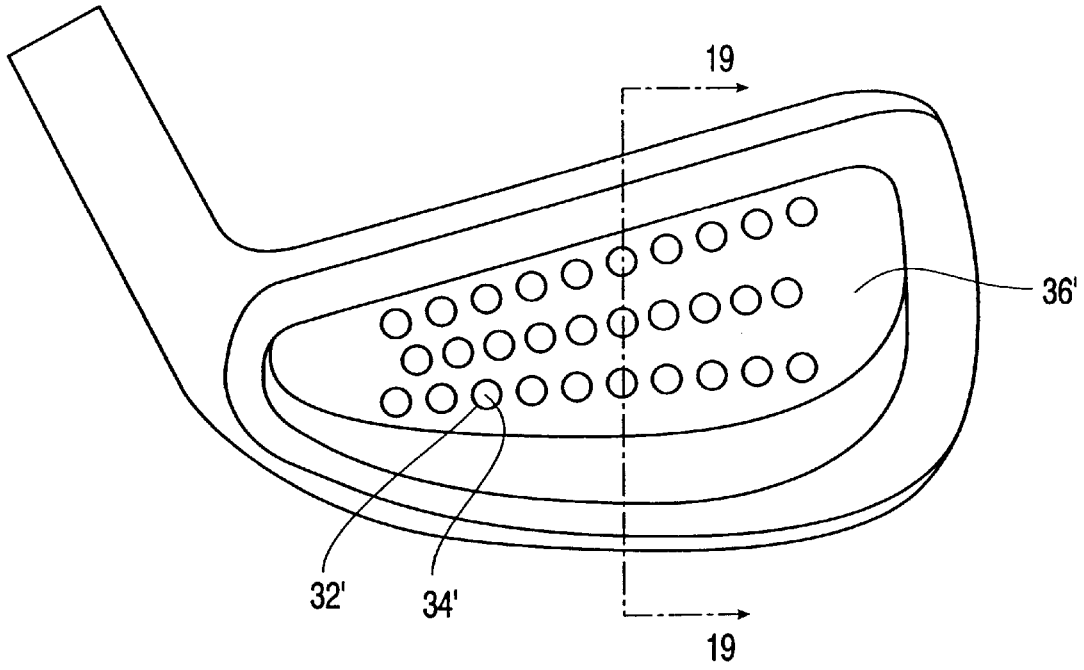
FIG. 18 is a rear view of the golf club head shown in FIG. 17 showing a plurality of apertures spaced apart on a back face of a club head.
Figure 19:
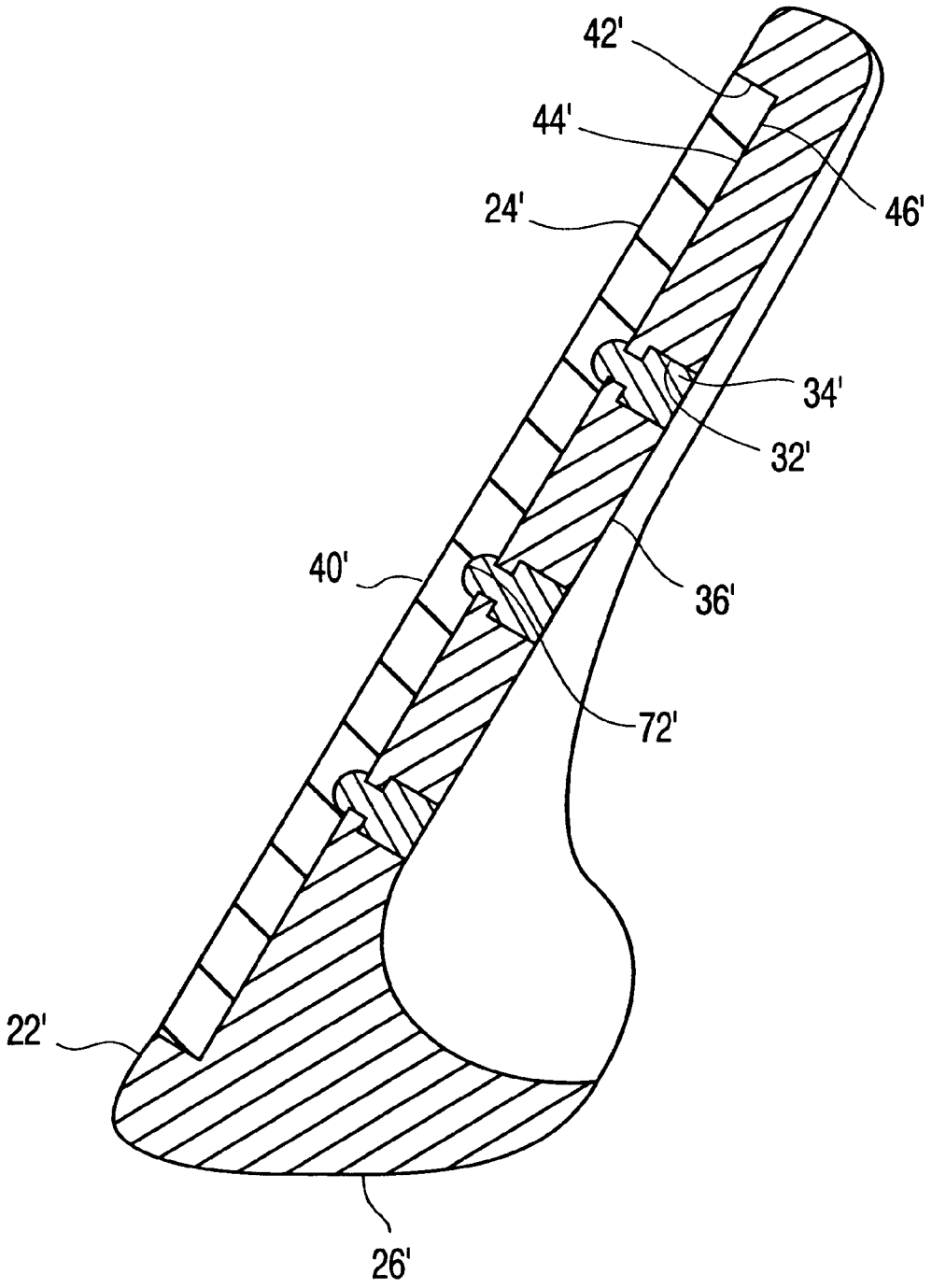
FIG. 19 is a cross-sectional view taken from line 19—19 of FIG. 18 showing the apertures filled with an elastomeric material.

Yet another embodiment is shown in FIGS. 17–19, which is similar to the above described embodiment shown in FIGS. 10–13, except that the club shown is an iron-type club. In this embodiment, the insert 24' material should be a harder material, such as titanium, for the low lofted clubs (2–4 irons), a softer material, such as steel, for the medium lofted clubs (5–7 irons), and yet a softer material, such tellurium copper, for the high lofted clubs (8-wedges).

I claim:

1. A golf club head having a toe and an opposite heel, a sole portion and an opposite top portion, a forwardly facing exposed strike face and an opposite rearwardly facing exposed back face portion, comprising:

a) an insert located in the strike face said insert having a back face;

b) a plurality of apertures extending from said back face portion and to the back face of said insert; in at least some of said apertures; and d) said insert and vibration dampening means being of different materials.

2. The golf club head of claim 1, wherein the insert is of a material that is different that the rest of the club head.

3. The golf club head of claim 2, wherein the insert is made of a copper alloy.

4. The golf club head of claim 2, wherein the insert is made of a tellurium copper alloy.

5. The golf club head of claim 4, wherein the insert is made of tellurium copper alloy and the rest of the golf club head is made of a carbon steel.

6. The golf club head of claim 1, wherein the vibration dampening means further comprises:

a) an elastomeric material extending into the back face portion.

7. The golf club head of claim 1, wherein the vibration dampening means is silicone.

8. A golf club head having a toe and an opposite heel, a sole portion and an opposite top portion, a strike face and an opposite back face portion, comprising:

a) an insert located in the strike face;

b) a first vibration dampening means located on the back face portion;

c) a plurality of apertures extending into the back face portion;

d) an elastomeric material located in each of the apertures;

e) a sweet spot on the club head;

f) a recess in the strike face located at said club head sweet spot and adapted to accept the insert so that the insert covers said club head sweet spot;

g) the strike face recess has a bottom surface;

h) the insert being located in the strike face recess; and i) said plurality of apertures extend from the back face portion into the strike face recess.

9. The golf club head of claim 8, wherein the insert further comprises:

a) an insert back face and wherein the insert back face is in contact with the strike face recess bottom surface.

10. The golf club head of claim 8, wherein said insert and said strike face recess have an interference fit in relation to each other.

11. The golf club head of claim 8, further comprising:

a) a fastening means that extends through at least one of said apertures to connect said insert to said back face portion.

12. The golf club head of claim 11, the fastening means further comprising:

a) a plurality of fasteners with each fastener having a head portion and a threaded portion;

b) said plurality of apertures having a plurality of complimentary counterbored holes adapted to accept the plurality of fasteners with the threaded portion of each fastener extending beyond said recess bottom surface; and c) said insert having a plurality of complimentary threaded holes adapted to accept said threaded portions of said fasteners.

13. The golf club head of claim 12, wherein:

a) said elastomeric material covers each said fastener head portion.

14. The golf club head of claim 12, wherein:

a) said back face portion has an outer periphery and said insert extends beyond said back face portion outer periphery; and b) said fasteners are aligned with said back face portion outer periphery.

15. The golf club head of claim 9, wherein said insert back face is in contact with said strike face recess bottom surface and said elastomeric material does not contact said insert.

16. The golf club head of claim 9, further comprising:

a) the insert back face further comprising a plurality of cavities that are aligned to be complementary with said plurality of apertures; and b) said elastomeric material extending into said insert cavities.

17. The golf club head of claim 16, wherein the insert back face further comprises:

a) a continuous passageway connecting each of said insert cavities; and b) said elastomeric material extends from said plurality of apertures into said insert cavities and said insert back face passageway.

18. The golf club head of claim 8, wherein:

a) said insert has a back face; and b) said insert back face is spaced from said strike face recess bottom surface to define a gap.

19. The golf club head of claim 18, wherein said gap is filled with a second vibration dampening means.

20. The golf club head of claim 19, wherein said second vibration dampening means is the same as said first vibration dampening means.

21. The golf club head of claim 8, wherein the golf club is a putter-type club.

22. The golf club head of claim 8, wherein the golf club is an iron-type club.

* * * * *

UNITED STATES PATENT AND TRADEMARK OFFICE
CERTIFICATE OF CORRECTION

PATENT NO. : 5,944,619

DATED : August 31, 1999

INVENTORS : Don T. CAMERON

It is certified that errors appear in the above-identified patent and that said Letters Patent is hereby corrected as shown below:

Column 3, line 48, delete "35".

Column 4, line 11, delete "30".

Column 5, line 23, after "insert;" add - - c) a vibration dampening means located - -.

Signed and Sealed this

Twenty-second Day of August, 2000

*Attest:*

Q. TODD DICKINSON

*Attesting Officer*

*Director of Patents and Trademarks*